US007350671B2

(12) United States Patent
Mika et al.

(10) Patent No.: US 7,350,671 B2
(45) Date of Patent: Apr. 1, 2008

(54) MULTI-USER TRANSFORMABLE WATER COOLER

(76) Inventors: Timothy D. Mika, 919 S. 14th Pl., Rogers, AR (US) 72758; Stephen J. Bowman, 1109 Oriole Ave., Rogers, AR (US) 72756

( * ) Notice: Subject to any disclaimer, the term of this patent is extended or adjusted under 35 U.S.C. 154(b) by 478 days.

(21) Appl. No.: 11/155,187

(22) Filed: Jun. 20, 2005

(65) Prior Publication Data

US 2006/0283883 A1 Dec. 21, 2006

(51) Int. Cl.
*B61D 5/56* (2006.01)

(52) U.S. Cl. ..... 222/129; 222/185.1; 248/136

(58) Field of Classification Search ..... 222/129, 222/180, 182, 182.2, 181.3, 185.1, 485, 482, 222/478; 248/126, 129, 127, 146, 150, 151, 248/155.4, 318, 440, 481, 166, 167, 173, 248/281.1, 213.2, 128, 136
See application file for complete search history.

(56) References Cited

U.S. PATENT DOCUMENTS 912,281 A * 2/1909 Higgins ..... 222/131
5,890,629 A * 4/1999 Loew ..... 222/144.5
6,058,733 A * 5/2000 Morgan ..... 62/389
6,517,036 B1 * 2/2003 Ramirez, Jr. ..... 248/150
6,578,802 B1 * 6/2003 Thier ..... 248/151
6,772,912 B1 * 8/2004 Schall et al. ..... 222/143
6,776,378 B1 * 8/2004 Yu ..... 248/146
6,814,333 B1 * 11/2004 Freiburger ..... 248/150
D528,344 S * 9/2006 Mika et al. ..... D7/307
2003/0150964 A1 * 8/2003 Sherer et al. ..... 248/146

* cited by examiner

*Primary Examiner*—Lien M. Ngo
(74) *Attorney, Agent, or Firm*—Stephen D. Carver

(57) ABSTRACT

A portable, multi-mode, multi-user cooler for storing and selectively dispensing beverages. A plastic, cylindrical container forms a hopper that mounts a removable top. Multiple, external recessed channels are formed in the container at radially spaced-apart locations. Deployable legs formed of multiple segments are housed within the channels when retracted. A plurality of user-actuable dispensing spigots that are radially spaced-apart around the periphery of the body are located between adjacent legs. Legs are deployed by unfolding them once removed from the storage channels. Selectively deployable, coaxial sleeves fitted to leg elements can be slidably deployed to lock the knees in axial alignment to secure and brace the legs. An internal divider partitions the container volume into separate compartments aligned with separate radially spaced-apart spigots.

20 Claims, 13 Drawing Sheets

MULTI-USER TRANSFORMABLE WATER COOLER

BACKGROUND OF THE INVENTION

1. Field of the Invention

The present invention relates generally to containers for holding ice and beverages or food of the type generally referred to as "coolers." More particularly, the present invention relates to coolers having multiple legs that can be either deployed to support the cooler above ground, or retracted and stowed by nesting them within the cooler body.

2. Description of the Related Art

Portable coolers for holding ice and selected food products or beverages are well known. Numerous structural variations, configurations, and accessories exist in the art. Many popular designs include a generally cylindrical body or hopper that includes a removable top for filling, and a user-actuable output spout. Some designs include wheels and a handle for pulling the cooler and moving it about. Many coolers have flat upper surfaces on their lids or covers which may be used as support surfaces.

Conventionally, portable coolers are deployed upon a supporting surface provided by a picnic bench, portable stand or the like. Known coolers have a single output spout, limiting them to one person at a time. This can be detrimental during team sports, for example, where proper hydration necessitates numerous water breaks. When a pause occurs during a team practice, players will seek a drink all at once. When more than one player desires a drink, single spout coolers are an obvious detriment.

U.S. Pat. No. 6,578,802 issued Jun. 17, 2003 shows an analogous water cooler support with a plurality of spaced-apart legs. Each of the legs is angled downwardly and outwardly.

U.S. Pat. No. 6,517,036 issued Feb. 11, 2003 shows a variety of water cooler holders that removably attach to vehicles, or which may be free standing. One holder disclosed in the reference resembles a tripod, and includes the three, pivotally attached legs that permit collapsing of the tripod for transport or storage.

U.S. Pat. No. 6,328,179 issued Dec. 11, 2001 shows a wheeled cooler with a body having wheels and a pivoted tow handle. Retractable bungee cords for securing various items to the cooler are provided.

U.S. Pat. No. 5,730,282 issued Mar. 24, 1998 shows a portable cooler that has self-locking legs that can be transformed into handles. Pivoted, U-shaped handles can be moved between an upwardly projecting position where they may be grasped by users for carrying the cooler to a downwardly projecting positions where they function as legs. Means are provided to temporarily lock the handles into position for use as legs.

U.S. Pat. No. 4,574,594 issued Mar. 11, 1986 discloses a portable table with locking legs. The legs are pivoted to support the platform above ground. The legs are provided with retractable locking rings that selectively secure them. The table has a handle, a recessed dry storage compartment, and a separate, recessed ice storage compartment separated from the dry storage compartment by a divider.

Known coolers or cooler supports suffer from many disadvantages. Single spout designs, for example, dispense beverages one at a time. In other words, only a single thirsty person can obtain a drink at a given time. Many coolers must be placed on a suitable, horizontal support platform or stand for use. Where a suitable stand or table is unavailable, they are placed upon the ground, and their low height makes actuation difficult. On the other hand, some coolers and cooler supports include legs for elevating the cooler where a stable platform or table is unavailable. However, typical folding leg designs are bulky and obtrusive. Typical designs are characterized by the fact that when the legs are retracted, they still protrude from the volume of the cooler, interfering with convenient carrying or storage.

Thus, we have endeavored to provide a multiple spigot cooler that can be deployed either upon a suitable, horizontal support, or directly above the ground or floor with various support legs that fold or unfold into position.

BRIEF SUMMARY OF THE INVENTION

This invention provides a rugged, portable cooler for storing ice and selected beverages or food products. The preferably plastic, cylindrical cooler body forms a hopper. A removable top normally encloses the interior. Multiple, spigots are radially spaced apart about the periphery of the body, so several people can draw a drink at once. The cooler can be easily transported and then placed vertically above ground upon a suitable table, bench, or other horizontal support for use. Where no convenient support exists, the cooler's multiple folding legs can be deployed to support the body above the ground or floor. When retracted, the multiple, foldable legs can be snap-fitted within suitable spaced-apart channels defined in the body. Thus when carrying or storing our cooler, the reduced volume of the assembly is less likely to collide with other objects or interfere with neighboring items.

The legs comprise multiple elements that are hinged together. Deployable sleeves that are coaxially fitted to the leg elements can be deployed to lock the knees of the legs in axial alignment to secure and brace the legs. The sleeves thus provide a stable support for the cooler body above ground. Afterwards, the legs can be folded into a carrying position by simply sliding the sleeves away from the knees, and then folding the legs into position. Once folded, the compacted legs can be snap-fitted into suitable receptive channels formed in the body. The multiple, radially spaced apart channels snugly receive and mount the folded legs for convenient storage. When the legs are retracted and nested for storage within the channels, the unit presents a minimal volume, making storage and manipulation easier. Thus, when carrying or storing our cooler, the reduced volume of the unit is less likely to collide with other objects or interfere with neighboring items. Preferably, for stability, the multiple spigots are mounted at radially spaced-apart intervals around the body between the leg storage channels.

Thus a basic object of our invention is to provide a portable, multi-user cooler for storing and cooling beverages or food.

Another important object is to provide a cooler of the character described that can be quickly transformed between elevated and free-standing orientations.

Another basic object is to provide a self-standing cooler that has multiple, stable legs.

Conversely, an important object is to provide a cooler that can be conveniently stowed or placed upon a suitable horizontal surface for use without support legs.

A fundamental object of our invention is to provide a cooler or drink stand that readily facilitates group and/or team thirst and hydration needs.

Another basic object is to provide for concurrent access by multiple users.

Yet another important object is to provide a cooler of the character described that can be configured for an efficient and comfortable pouring height.

A further object is to provide a cooler characterized by multiple pouring options.

A related object is to provide a cooler of the character described that expedites player hydration during demanding, time-sensitive team sports.

It is also an object of our invention to provide a cooler of the character described that is quickly and easily filled or deployed.

A basic object is to provide a rugged and dependable cooler that is ideal for numerous applications, including beach use, camping, playground, team activities, family reunions, picnics, disaster relief, parties, school field trips, barbeques, fund raisers, fairs, training, camps, seminars, festivals, church retreats, garage sales, tournaments, and the like.

It is another object of the present invention to provide a water cooler which may be easily and efficiently transported and stowed.

It is a further object of the present invention to provide a multi-mode, transformable cooler that is durable, reliable, and easy to use.

Still another object of the present invention is to provide an improved, high-volume water cooler that allows convenient access to numerous users at once.

Yet another object of our invention is to provide a water cooler with selectively-deployable legs that can be flushly nested in a convenient, out-of-the-way orientation when the unit is stowed, transported, or deployed in such a manner that use of the legs is unnecessary.

Yet another object of the present invention is to provide a water cooler of the character described whose interior can hold several different drinks, and whose exterior provides separate spouts for each of them.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
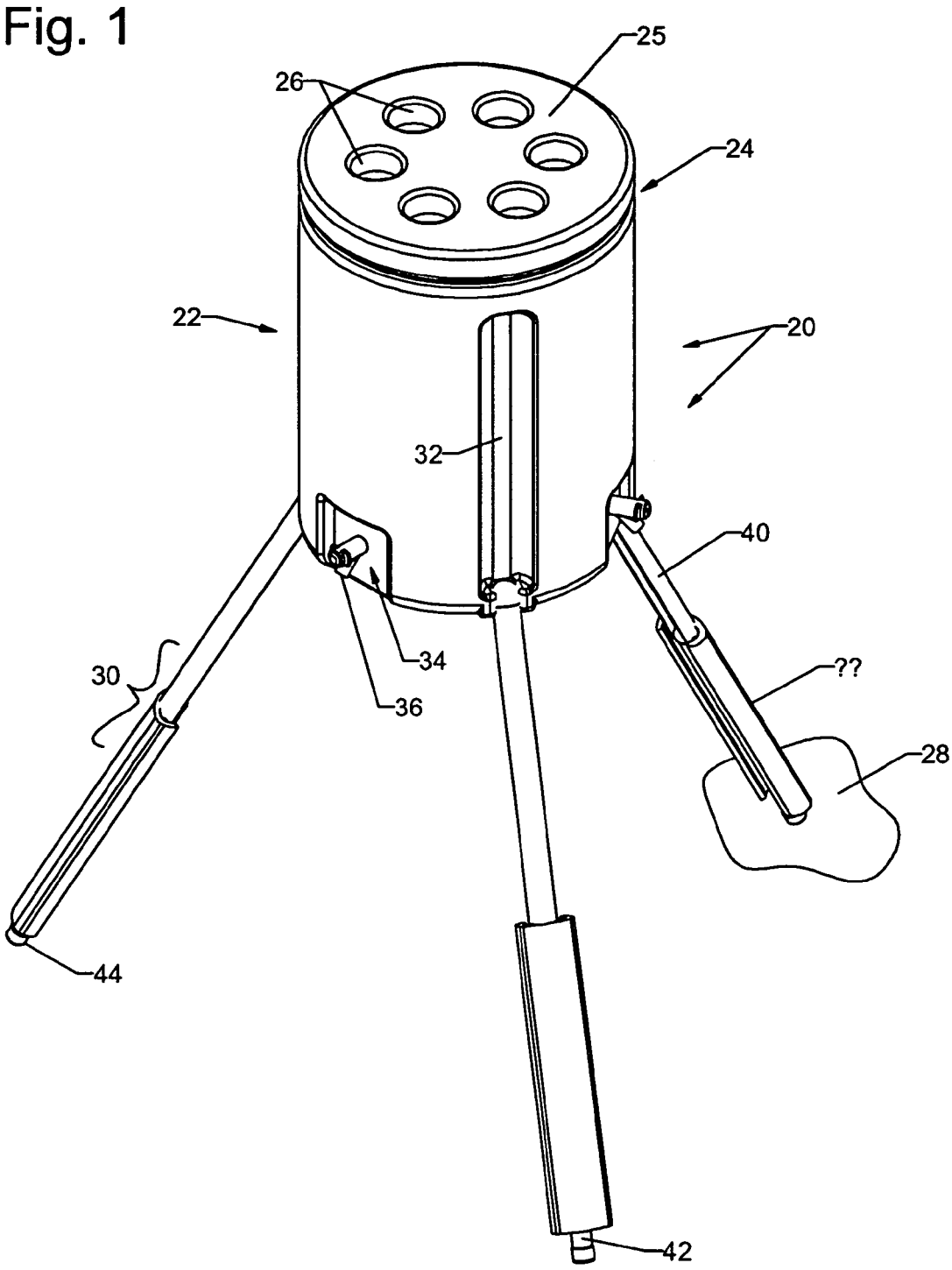
FIG. 1 is a frontal isometric view of the best mode of our new water cooler, with the legs deployed.
Figure 2:
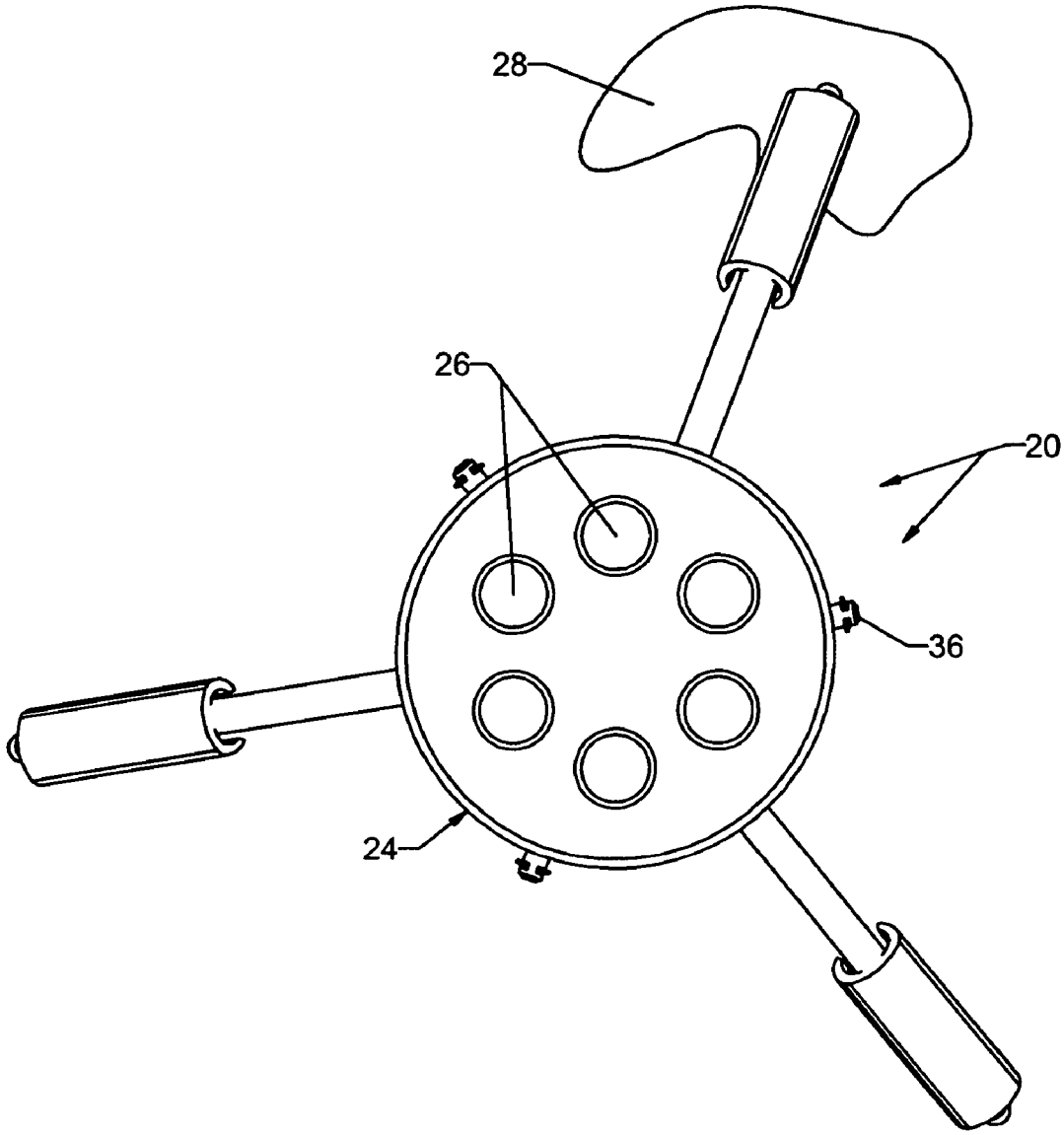
FIG. 2 is a top plan view thereof.
Figure 3:
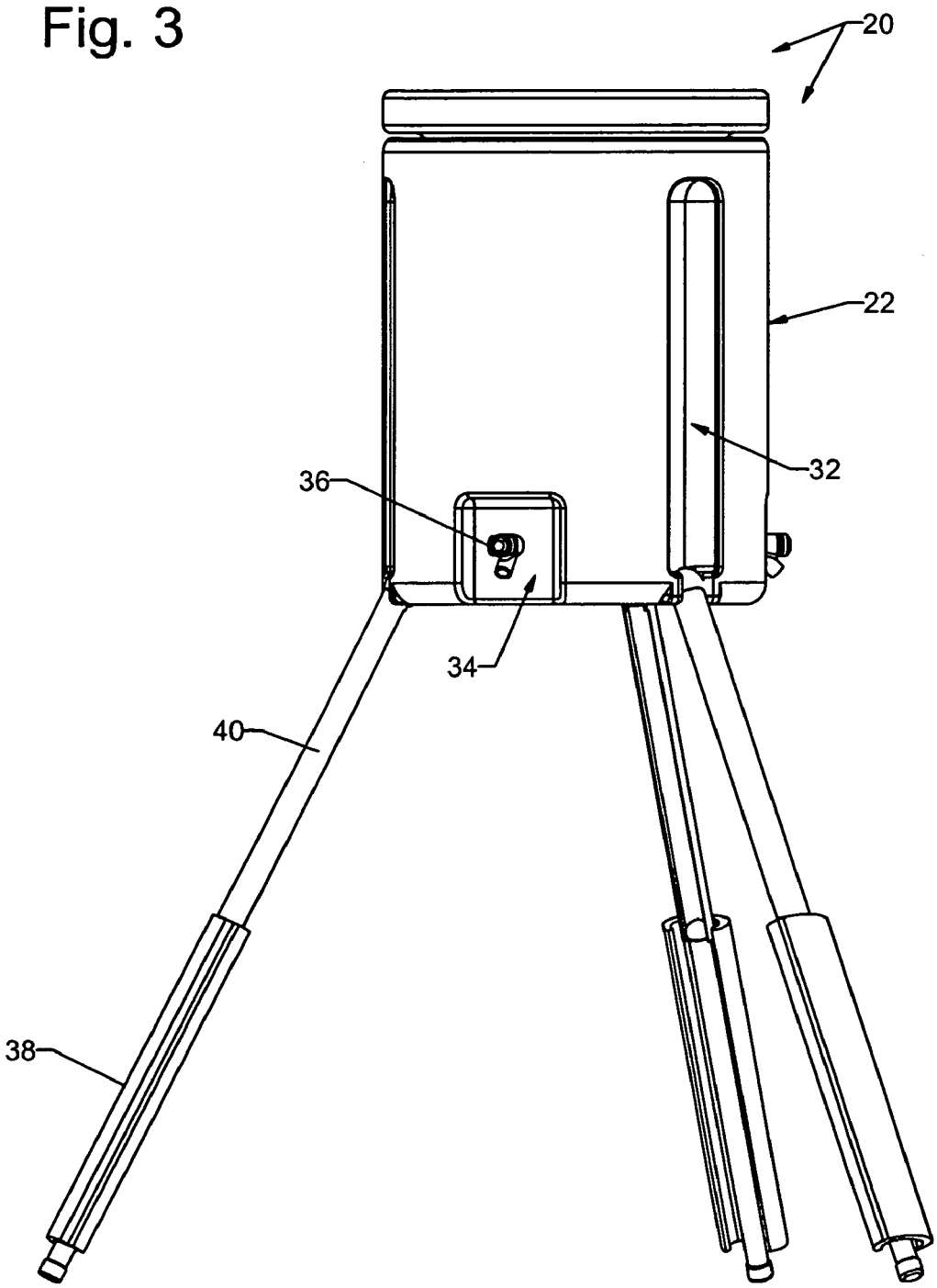
FIG. 3 is a front elevational view thereof.

With initial reference directed now to FIGS. 1-6 of the appended drawings, a multi-mode, multi-user, transformable cooler constructed generally in accordance with the best mode of the invention known to us at this time has been generally designated by the reference numeral 20. The cooler 20 comprises a cylindrical container 22 to which a removable lid 24 may be threadably attached. Preferably container 22 and lid 24 that encloses its interior are made of resilient plastic. In the best mode, the upper, exposed outer surface 25 of the lid 24 has a plurality of radially spaced-apart, cavities 26 into which drink containers such as glasses, cups, cans or the like may be placed.

Container 22 is supported and deployed above a supporting surface such as the ground 28 (i.e., FIG. 1) by a plurality of foldable legs 30, to be described in more detail hereinafter. When not in use, legs 30 are folded and stored within recessed channels 32 that are radially spaced-apart about the generally tubular periphery 23 of container 22. Preferably, there are a plurality of flat, recessed service ports 34 that are radially spaced-apart around the periphery of the cooler as well. Each service port 34 mounts a dispensing spigot 36 that is in fluid flow communication with the cooler interior. Each service port 34 is preferably disposed midway between adjacent channels 32, i.e., between neighboring legs 30, to enhance and establish balance and stability.

Figure 7:
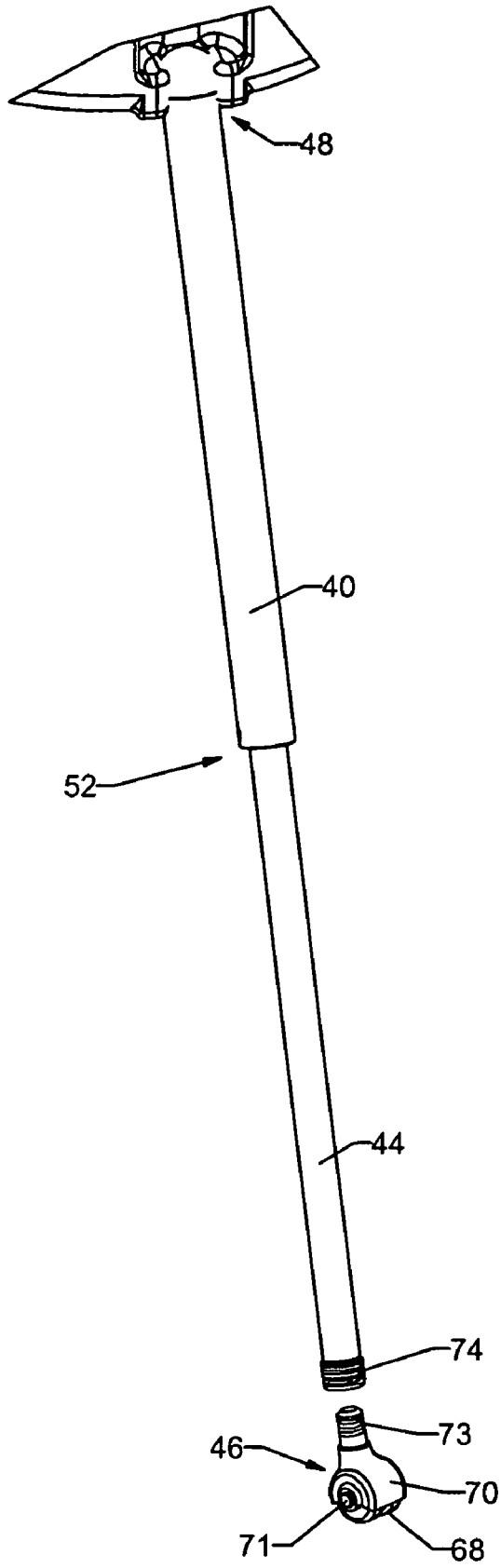
FIG. 7 is an enlarged, fragmentary isometric view of a preferred leg showing an optional caster wheel assembly, with portions omitted for brevity and clarity.
Figure 8:
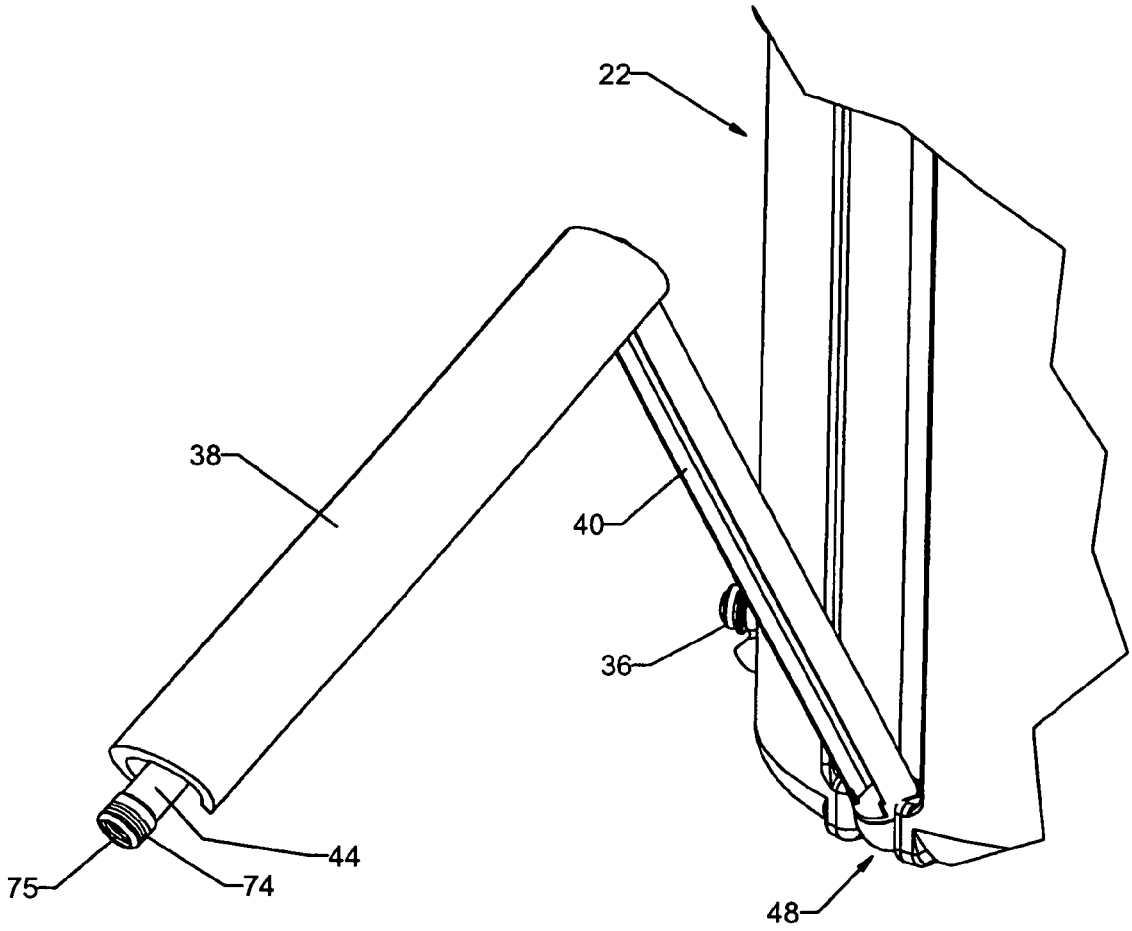
FIG. 8 is an enlarged, fragmentary isometric view of a partially folded leg.
Figure 9:
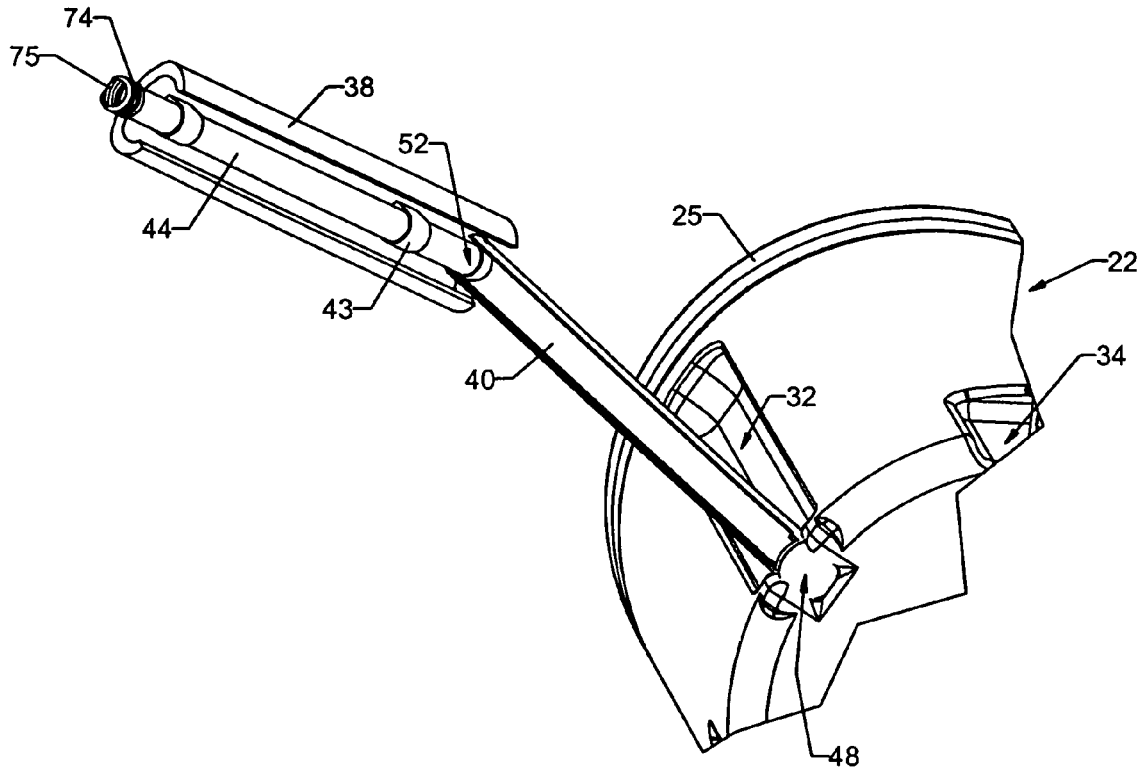
FIG. 9 is an enlarged, fragmentary isometric view of a almost-fully deployed leg.

With additional reference now directed to FIGS. 7-9, the multiple, radially spaced-apart legs 30 comprise separate, cooperating segments that are preferably hinged together. While it is preferred that the legs are foldable, alternative arrangements, such as fully telescoping designs, could be used. The legs 30 are preferably disposed between the service ports 34 (and between the spigots 36) to promote balance, and to optimize overall strength and stability. Each leg 30 preferably comprises an upper segment 40, a deployable sleeve 42, and a lower, tubular segment 44. A suitable caster wheel assembly 46 is optionally connected to each leg 30 at the bottom of lower segment 44. When deployed, the leg segments 42 and 44 are aligned axially, as seen, for example, in FIGS. 1, 4, and 7, and they are maintained in this position by slidable sleeves 42.

Each upper leg segment 40 (FIG. 7) is preferably attached to container 22 with a ball and socket hinge, generally designated by the reference numeral 48, disposed at the underside of container 22 beneath a recessed channel 32. An integral ball 49 formed at the top of leg segment 40 is received within a suitable socket 50 beneath container 22. Retainers 51 (FIG. 9) preferably secure opposite sides of ball 49 to secure ball 49 within socket 50.

The lower end of the upper leg segment 40 is pivotally coupled to lower leg segment 44 with pivoted knee joint, generally designated by the reference numeral 55. Leg segment 40 is generally C-shaped in cross section, defining a pair of edges 53 on opposite sides of a central channel 54 (i.e., FIG. 9). The uppermost end of the generally tubular lower leg segment 44 is hinged between edges 53 within channel 54 to form the bendable or foldable knee joint 55.

Figure 4:
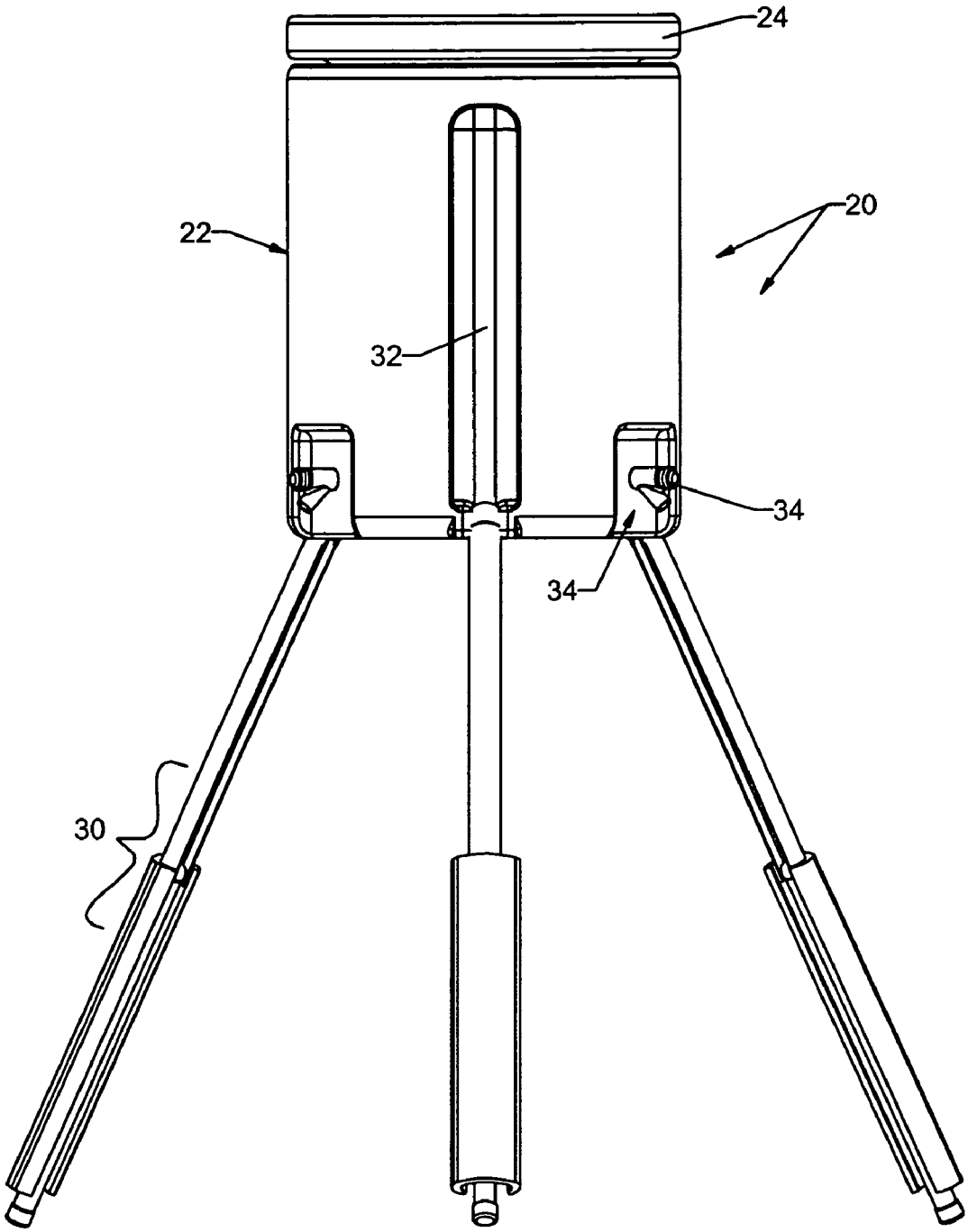
FIG. 4 is a right side elevational view thereof.
Figure 5:
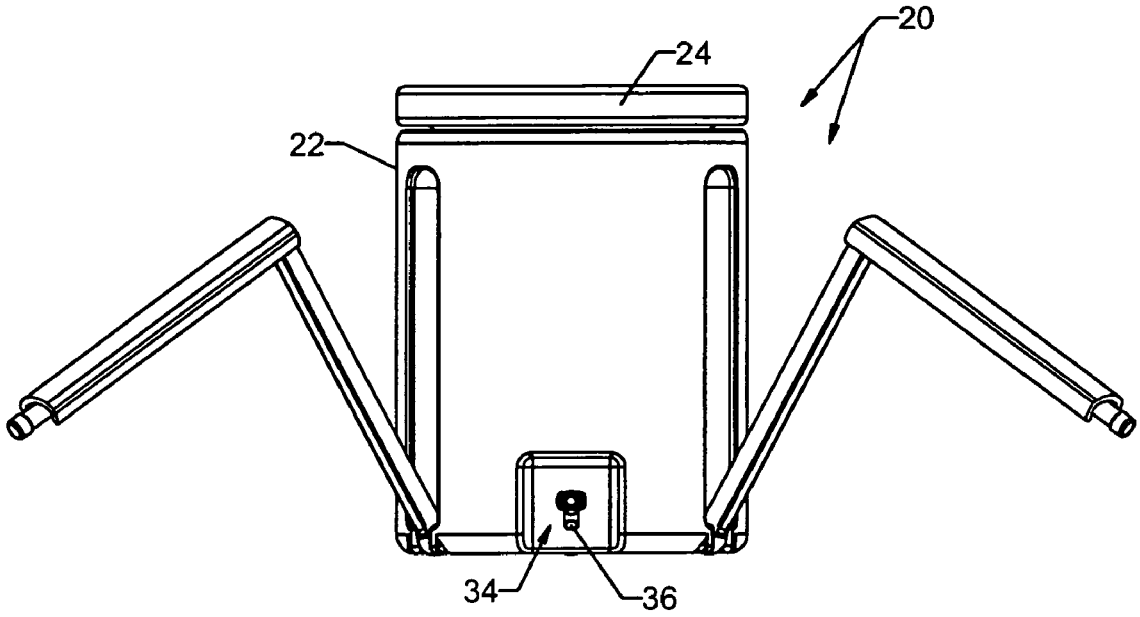
FIG. 5 is a front plan view of the cooler with the legs partially retracted.
Figure 10:
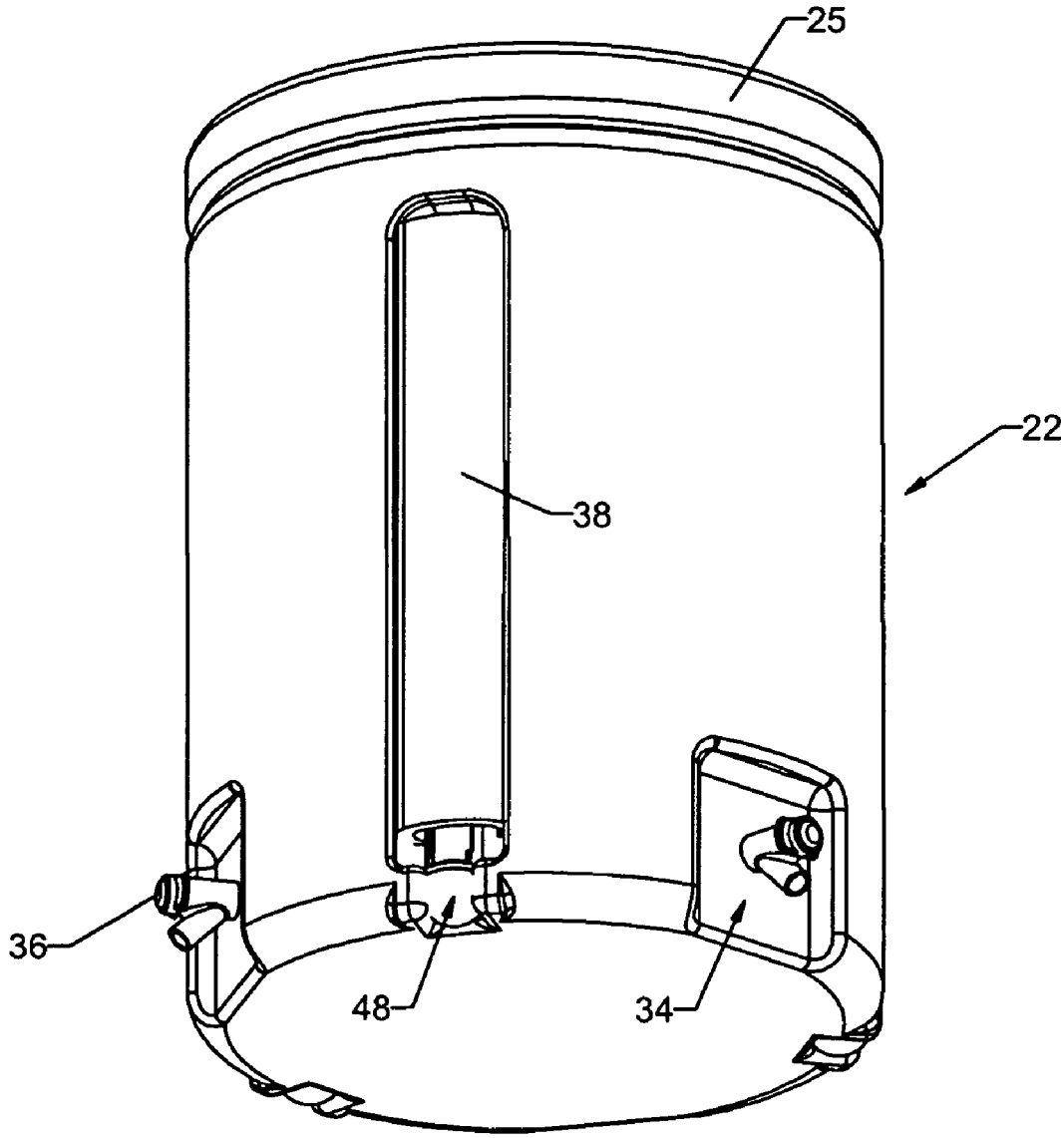
FIG. 10 is an enlarged, isometric view of the cooler with the legs retracted.
Figure 11:
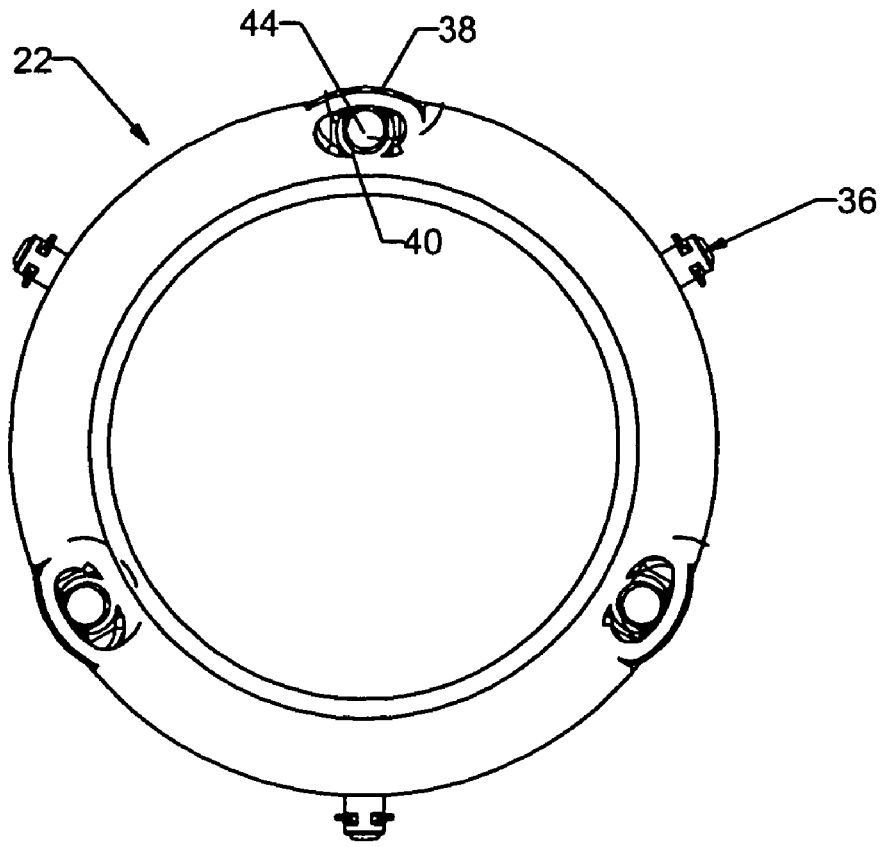
FIG. 11 is an enlarged, bottom isometric view of the cooler with the legs retracted.
Figure 12:
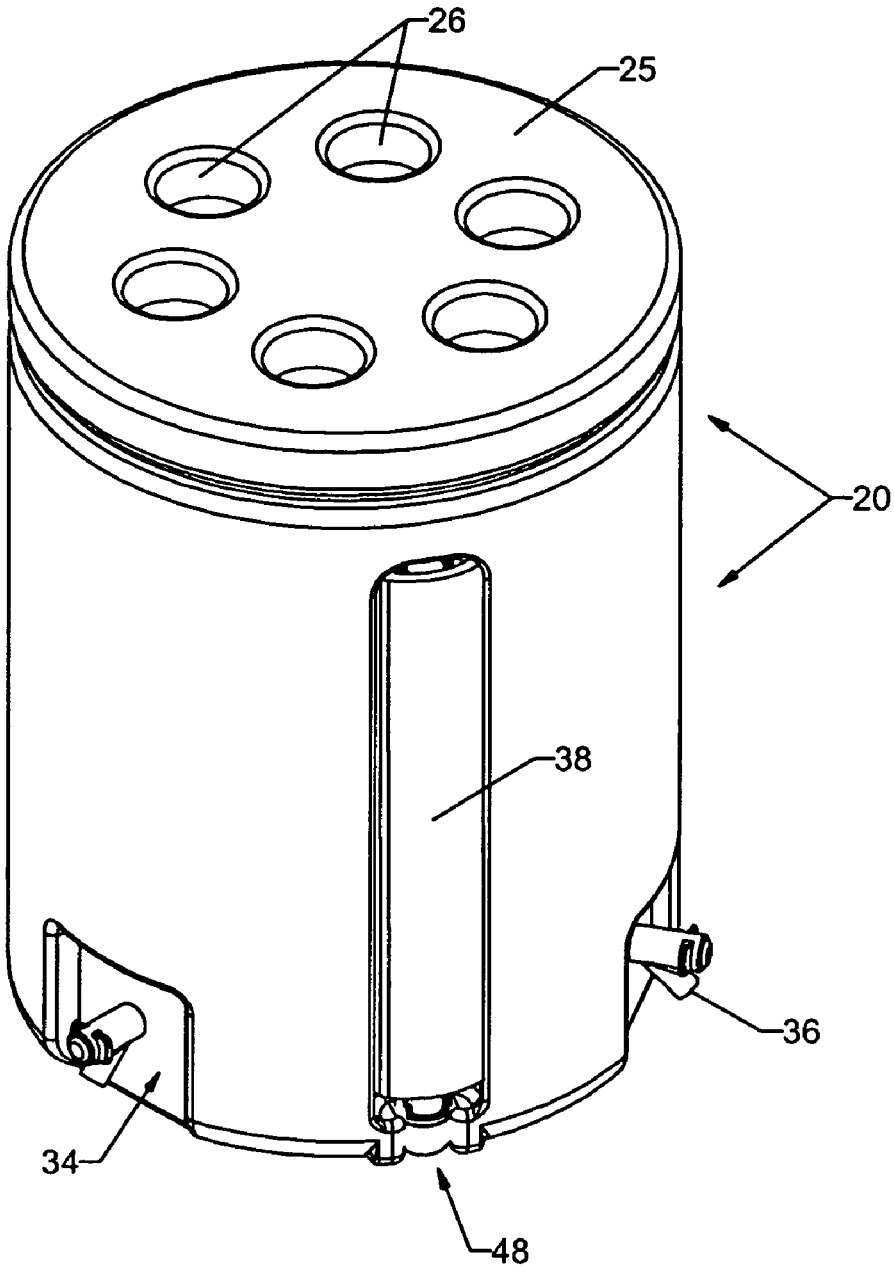
FIG. 12 is an enlarged, top isometric view of the preferred cooler with the legs foldably retracted and stowed.

The articulation established by knee joint 55 combined with the folding action enabled by the upper ball and socket hinge 48 allows and facilitates a compound motion that enables transformation of folded leg segments between the deployed configurations of FIGS. 1 and 4 to the nested orientation as seen in, for example, FIGS. 10 and 11. The intermediate folded leg orientations of FIGS. 8 and 9, for example, are enabled as well. When the legs 30 are deployed, the axially aligned operational configuration of FIG. 1, for example, is preserved by deployment of locking sleeves 42, that are slidably moved to cover the leg knee regions 55.

Figure 13:
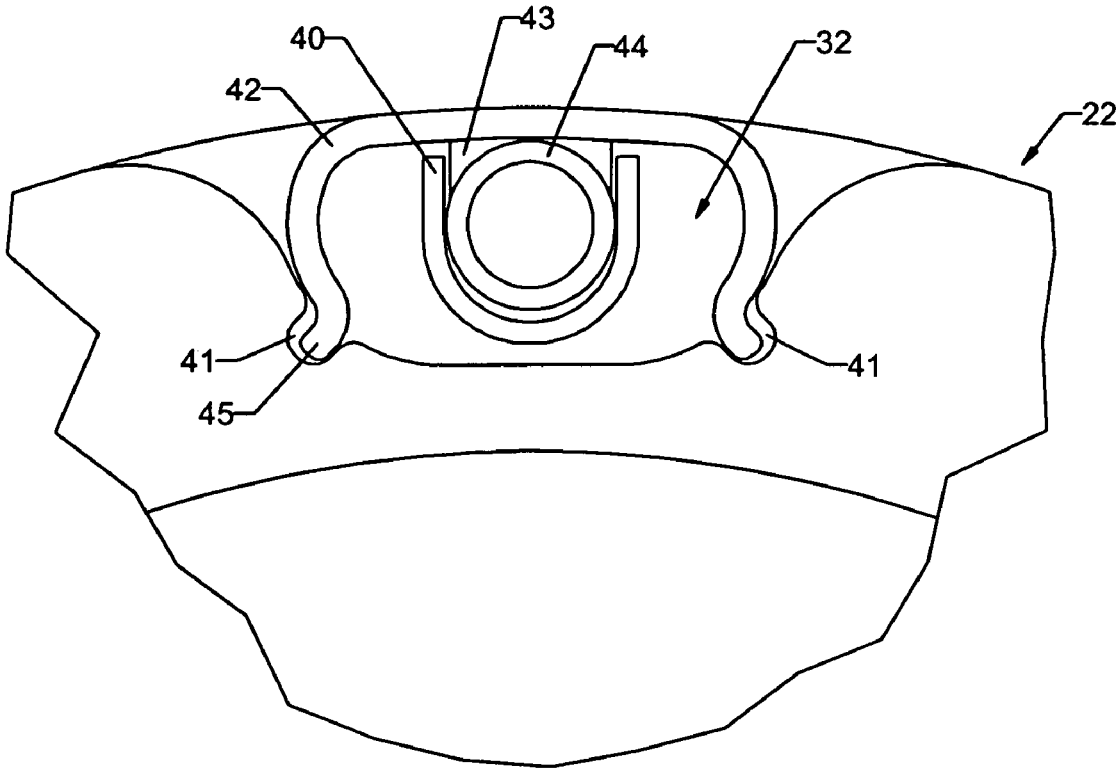
FIG. 13 is an enlarged, fragmentary sectional view of a nested leg.

The resilient, tubular locking sleeves 42, which are made of deformable plastic, are placed over the leg knee regions in assembly, over the aligned leg segments 40, 44. When the legs 30 are retracted, the leg segments and the sleeves nest within the recessed channels 32. Referencing FIG. 13, channels 32 have a pair of retainer slots 41 defined at opposite, internal sides. Sleeve 42 has an internal bracket 43 that snap fits to leg 44. The lower, inurned feet of 45 of the sleeve 42 engage slots 41 when the legs are retracted. The sleeve may be gently squeezed to attach them as in FIG. 13. The locking sleeves 42 are thus conveniently secured within channels 32.

Referencing FIG. 7, each caster wheel assembly 46 preferably comprises a conventional roller wheel 68 (FIG. 7) that is rotatably secured within a fork-like cradle 70 by an axle 71. Stem 73 has threads mate within threads 74 formed in the bottom interior of lower leg segment 44. In this manner each caster wheel assembly 46 is adjustable, in that the effective length of the leg 30 can be adjusted telescopingly by rotating the wheel assemblies 46 (i.e., cradle 70) where slight height adjustments are desired.

Figure 6:
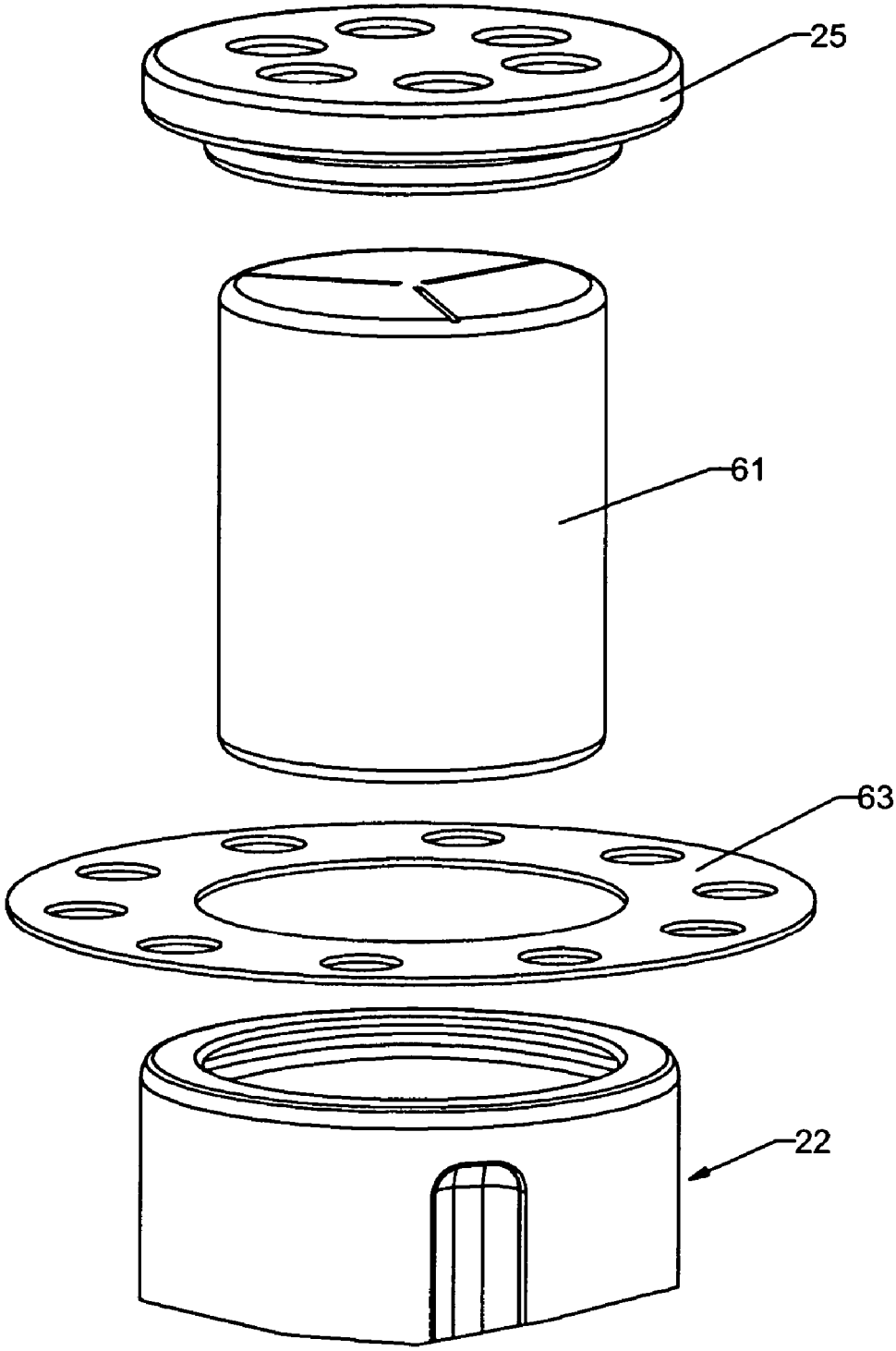
FIG. 6 is a fragmentary, partially exploded isometric view thereof.

Referencing FIG. 6, top 24 preferably has downwardly projecting threads 90 that mate within internal threads 91 formed at the top interior of container 22. An optional, tubular insert 80 can be coaxially inserted within container 22 to divide the interior into a plurality of separate volumes. Insert 80 has an internal divider partition 92 having three radially spaced apart wings 93 forming separate internal compartments 95, 96, and 97. The compartments 95-97 are defined between radially spaced apart wings 93 of the divider partition 92 and the bordering internal periphery of container 22. In assembly, inset 80 is rotationally positioned such that each of the three separate compartments it forms when coaxially disposed within container 22 are aligned adjacent a separate service port 34, so there is a separate spigot 36 available for each different compartment 95-97.

An optional, annular shelf 100 (FIG. 6) may be fitted over container 22 to increase the number of cup holes available to users. Shelf 100 has an internal orifice 101 through which container 22 is positioned. The annular shelf body 103 has a plurality of cup receptive orifices 105 that can hold various beverage cups.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable, multi-user, multi-mode cooler for storing and cooling beverages, the cooler comprising;

a container having a top, a bottom, a periphery, and an interior;

a removable lid adapted to be attached to the container top;

a plurality of recessed channels radially spaced apart the periphery of the container;

a plurality of foldable legs coupled to the container and radially spaced apart its periphery, the legs aligned with said channels and adapted to be at least temporarily foldably stored within the channels when the legs are not deployed, and wherein the legs comprise an upper segment coupled to the container, and a lower segment hinged to the upper segment at a knee region; and, a plurality of user-actuable output spigots radially spaced apart about the periphery of the cooler container, the spigots being in fluid flow communication with the container interior.

2. The cooler as defined in claim 1 wherein the lid comprises a plurality of radially spaced-apart cavities into which containers may be placed.

3. The cooler as defined in claim 1 wherein the output spigots are disposed midway between adjacent legs.

4. The cooler as defined in claim 1 wherein each leg comprises separate, cooperating segments that are hinged together, and which can be folded into axial alignment.

5. The cooler as defined in claim 4 wherein each leg comprises an upper segment coupled to the cooler proximate the container bottom with a ball and socket, a lower segment hinged to the upper segment at a knee region, and wherein the lower segment terminates in a caster wheel assembly that supports the cooler upon the ground or a supporting surface.

6. The cooler as defined in claim 5 wherein each caster wheel assembly comprises a roller wheel rotatably secured within a cradle, the cradle comprising a stem adapted to be telescopingly coupled to the lower leg segment.

7. The cooler as defined in claim 1 wherein the knee region is covered by a sleeve when the cooler is deployed.

8. The cooler as defined in claim 7 wherein the sleeve is elongated and tubular, an is generally coaxially fitted over the leg at a position covering said knee region to reinforce and strengthen the leg.

9. The cooler as defined in claim 6 wherein the stem and the lower leg segment are threadably coupled together.

10. A portable multi-mode cooler for storing and cooling beverages, the cooler comprising;

a generally cylindrical container having a top, a bottom, a periphery, and an interior;

a plurality of recessed channels radially spaced apart the periphery of the container;

a plurality of foldable legs coupled to the container and radially spaced apart its periphery, the legs aligned with said channels and adapted to be at least temporarily foldably stored within the channels when the legs are not deployed, and wherein the legs comprise an upper segment coupled to the container, and a lower segment hinged to the upper segment at a knee region; and, a plurality of user-actuable output spigots radially spaced apart about the periphery of the cooler container, the spigots being in fluid flow communication with the container interior.

11. The cooler as defined in claim 10 wherein each leg comprises separate, cooperating segments that are hinged together, and which can be folded into axial alignment.

12. The cooler as defined in claim 11 wherein the output spigots are disposed midway between adjacent legs.

13. The cooler as defined in claim 10 wherein the lid comprises a plurality of radially spaced-apart cavities into which containers may be placed.

14. The cooler as defined in claim 13 wherein each leg comprises an upper segment coupled to the cooler proximate the container bottom with a ball and socket, a lower segment hinged to the upper segment at a knee region, and wherein the lower segment terminates in a caster wheel assembly that supports the cooler upon the ground or a supporting surface.

15. The cooler as defined in claim 14 wherein each caster wheel assembly comprises a roller wheel rotatably secured within a cradle, the cradle comprising a stem adapted to be threadably coupled to the lower leg segment.

16. The cooler as defined in claim 14 wherein the knee region is covered by a sleeve when the cooler is deployed.

17. The cooler as defined in claim 16 wherein the sleeve is elongated and tubular, and is generally coaxially fitted over the leg at a position covering said knee region to reinforce and strengthen the leg.

18. The cooler as defined in claim 10 further comprising an insert adapted to be coaxially inserted within the container to divide the container interior into a plurality of separate volumes.

19. The cooler as defined in claim 18 wherein the insert has an internal divider partition having three radially spaced apart wings forming separate internal compartments adapted to be aligned with separate output spigots.

20. The cooler as defined in claim 10 further comprising an annular shelf adapted to be fitted over the container, the annular shelf container compassing a plurality of receptive orifices.

* * * * *